United States Patent [19]

Okada

[11] 4,432,288

[45] Feb. 21, 1984

[54] COMBUSTION APPARATUS FOR GRANULAR SOLID FUEL

[75] Inventor: Kiyomi Okada, Ube, Japan

[73] Assignee: San Energy Co., Ltd., Ube, Japan

[21] Appl. No.: 327,258

[22] Filed: Dec. 3, 1981

[30] Foreign Application Priority Data

| | | | |
|---|---|---|---|
| Dec. 9, 1980 | [JP] | Japan | 55-172550 |
| Jun. 10, 1981 | [JP] | Japan | 56-88030 |
| Jun. 27, 1981 | [JP] | Japan | 56-133350 |

[51] Int. Cl.[3] ..... F23D 1/00

[52] U.S. Cl. ..... 110/266; 110/165 R; 110/171; 110/264; 110/347

[58] Field of Search ..... 110/263, 264, 266, 165 R, 110/171, 347; 431/2, 9, 350, 353

[56] References Cited

U.S. PATENT DOCUMENTS

| | | | |
|---|---|---|---|
| 2,717,563 | 9/1955 | Sifrin | 110/266 |
| 2,800,093 | 7/1957 | Burg | 110/264 |
| 3,738,816 | 6/1973 | Hirt | 431/353 |
| 4,144,019 | 3/1979 | Lyshkow et al. | 110/264 |
| 4,333,405 | 6/1982 | Michelfelder et al. | 110/264 |

FOREIGN PATENT DOCUMENTS

| | | | |
|---|---|---|---|
| 29235 | 5/1981 | European Pat. Off. | 110/171 |

*Primary Examiner*—Edward G. Favors
*Assistant Examiner*—Steven E. Warner
*Attorney, Agent, or Firm*—Kurt Kelman

[57] ABSTRACT

A combustion apparatus for a granular solid fuel, comprising a plurality of horizontal cylindrical combustion chambers serially connected in their axial direction, partitions interposed between the combustion chambers, communication holes pierced through the partitions for passing the combustion gas. To the combustion chambers, air is delivered in directions to cause the gas to flow in a swirled state, allow the granular fuel to be burnt as agitated and fluidized within the upstream combustion chamber, and forward the gas in a swirled state from the upstream to the downstream combustion chamber. The combusted gas, on reaching the extreme downstream combustion chamber is drawn out by means of a gas delivery pipe having one end thereof communicating with the combustion chamber.

2 Claims, 15 Drawing Figures

COMBUSTION APPARATUS FOR GRANULAR SOLID FUEL

BACKGROUND OF THE INVENTION:

This invention relates to a combustion apparatus for use as a heat source for hot water systems, space heating systems, green houses, driers, etc., and more particularly to a combustion apparatus using a granular solid fuel.

The anxiety about the supply of oil has led to a re-evaluation of coal and other solid fuels. It is, however, difficult to effect complete combustion of such solid fuels or to derive high thermal power from such solid fuels by use of a simple device. Among other various forms of combustion, the so-called fluidized-bed combustion which involves granulating or pulverizing a solid fuel, fluidizing the resultant granular solid fuel as by aerial agitation, and burning the fuel in the fluidized state has come to attract keen interest as a method promising a solution to the problem mentioned above. Unfortunately, it is still difficult to carry out this fluidized-bed combustion successfully in a small combustion apparatus of a relatively simple construction. Further the combustion apparatus using a solid fuel inevitably entails accumulation of ashes in the dust collector. Since the combustion gas remains under the conditions of high temperature and high pressure during the operation of the combustion apparatus, it is dangerous to bypass the combustion gas from the apparatus. Any attempt to bypass the combustion gas results in some degradation of the operational efficiency of the combustion apparatus.

SUMMARY OF THE INVENTION

An object of this invention is to provide a combustion apparatus which has a simple construction and provides complete combustion of a pulverized or granulated solid fuel with high efficiency.

To accomplish the object described above according to the present invention, there is provided a combustion apparatus comprising a plurality of cylindrical combustion chambers serially disposed with their respective axes running horizontally. First in the upstream combustion chamber, the pulverized or granulated solid fuel (hereinafter referred to briefly as "granular fuel") supplied as carried on a current of air is fluidized by agitation and burnt in the fluidized state. The combustion gas thus produced is blown out into the peripheral portion of the next combustion chamber, there to be swirled in a spiral with secondary air and burnt the second time in the swirled state. In either of the combustion chambers mentioned above, the granular fuel is burnt as kept in a swirled state with the forced current of air. Into the downstream combustion chamber, one end of a combustion gas outlet tube is opened to permit removal of the combustion gas to the outside.

As described above, the combustion apparatus according to the present invention comprises a plurality of cylindrical combustion chambers, in each of which the granular fuel is fluidized and swirled and burnt in the fluidized and swirled state. The combustion gas produced in one combustion chamber is forwarded to the immediately next combustion chamber. Thus, the combustion apparatus of the present invention provides complete combustion of the solid fuel and derives high thermal power from the fuel.

The other objects and characteristics of the present invention will become apparent from the further disclosure of the invention to be made hereinafter with reference to the accompanying drawings.

DESCRIPTION OF PREFERRED EMBODIMENTS

Figure 1:
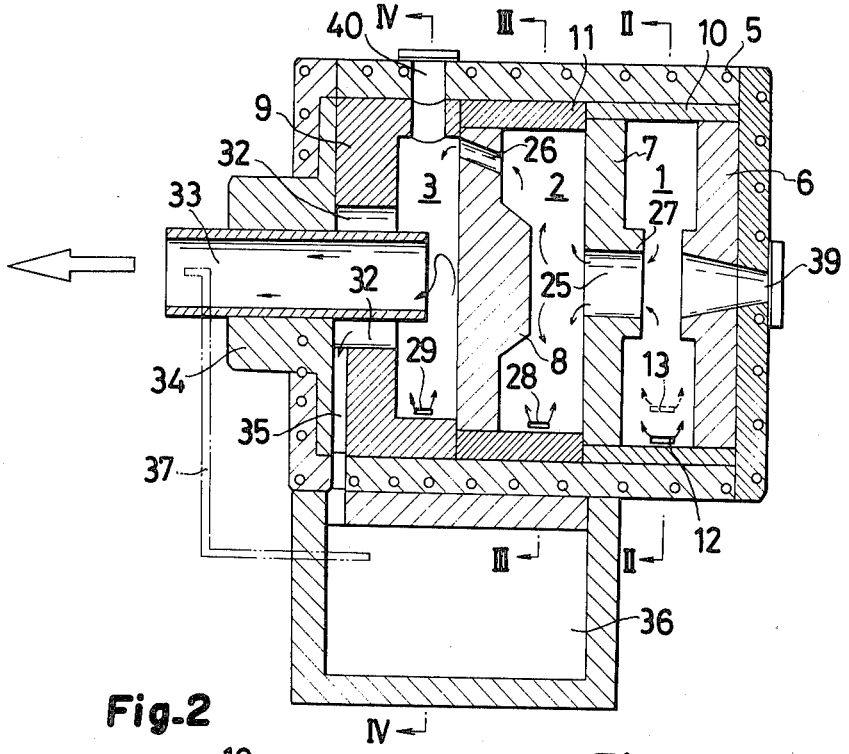
FIG. 1 is a longitudinal cross section illustrating one embodiment of the combustion apparatus according to the present invention.

The first embodiment of the combustion apparatus according to the present invention will be described with reference to FIGS. 1-6.

The combustion apparatus is chiefly composed of a primary combustion chamber 1, a secondary combustion chamber 2, and a tertiary combustion chamber 3. These combustion chambers are horizontal cylinders having their respective axes horizontally. Besides the combustion chambers, the combustion apparatus comprises a peripheral insulating structure 5, and partitions 6, 7, 8, and 9 and tubes 10 and 11 made of a refractory material and disposed within the insulating structure 5.

Figure 2:
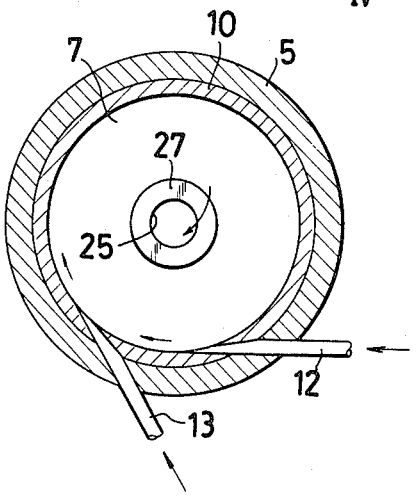
FIG. 2 is a sectioned view taken along the line II—II in FIG. 1.
Figure 5:
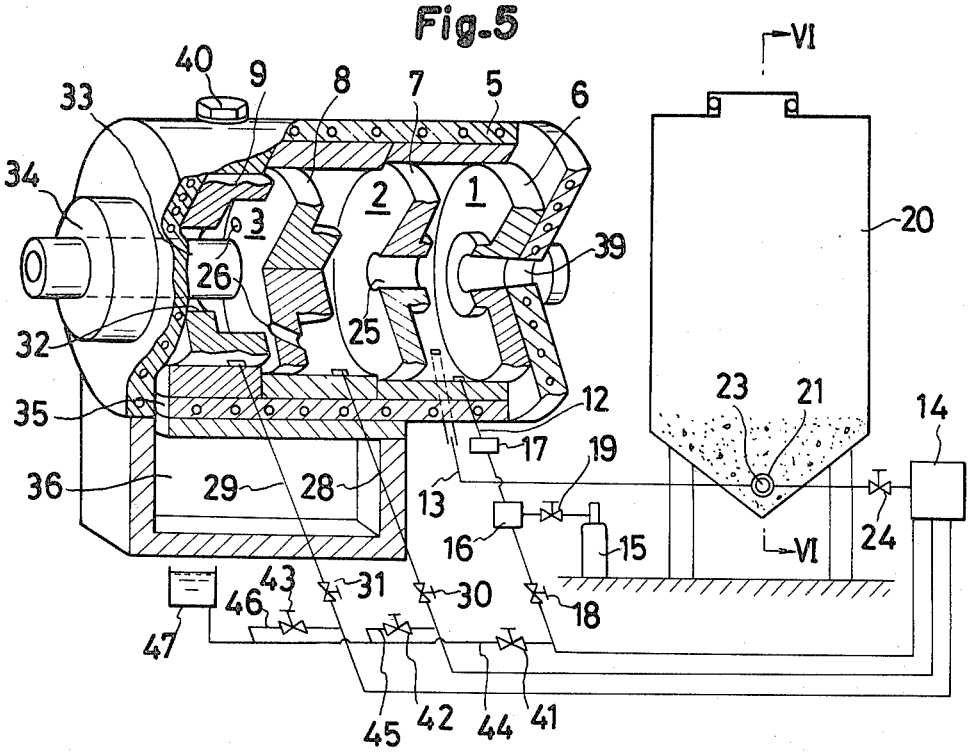
FIG. 5 is a partially sectioned perspective view of the combustion apparatus of FIG. 1, illustrating a piping system involved in the combustion apparatus.

In the primary combustion chamber 1, a primary air feed pipe 12 opens in a tangential direction into the chamber at the lower side thereof and a fuel feed pipe 13 similarly opens in a tangential direction into the chamber at the lower lateral side thereof, namely near an extension of the primary air feed pipe 12, as illustrated in FIG. 2. This particular disposition of the two pipes is advantageous for the purpose of aerially agitating and fluidizing the granular fuel supplied through the fuel feed pipe 13 into the combustion chamber 1. At an upstream point of the primary air feed pipe 12, there is provided an ejector 16 for mixing the air from a blower 14 and the gas from an ignition gas cylinder 15 and ejecting the mixture as illustrated in FIG. 5. At the time that the combustion is started in the system, the mixed gas from this ejector is ignited by means of an ignition plug 17. By 18 and 19 are denoted switch valves respectively for the primary air and the ignition gas. Optionally, the primary air feed pipe 12 may be omitted by adapting the fuel feed pipe 13 so as to permit concurrent supply of a large volume of air. In this case, the primary air feed pipe 12 is used solely for the purpose of ignition.

Figure 6:
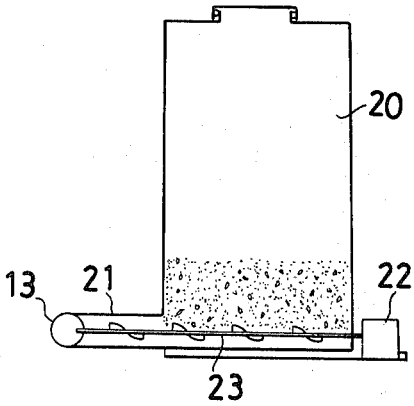
FIG. 6 is a sectioned view taken along the line VI—VI in FIG. 5.

The other end of the fuel feed pipe 13 extending from the combustion chamber 1 is connected with the aforementioned blower 14 (FIG. 5). The pipe interconnecting the blower 14 and the combustion chamber 1 is joined by a fuel mixing pipe 21 in a fuel storage hopper 20. In the fuel mixing pipe 21 is a conveyor screw 23 which is operated by a drive unit 22 (FIG. 6). By the rotation of this screw 23, the granular fuel within the hopper 20 is guided into the fuel feed pipe 13. The feed volume of the fuel can be adjusted by suitably varying the rate of the rotation of the conveyor screw 23 and that of the air by suitably regulating the aperture of a flow volume regulating valve 24.

Figure 3:
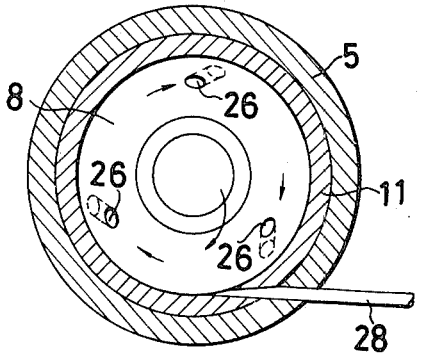
FIG. 3 is a sectioned view taken along the line III—III in FIG. 1.

The secondary combustion chamber 2 communicates with the primary combustion chamber 1 via an axial communication hole 25 at the center of the partition 7, and the tertiary combustion chamber 3 communicates with the secondary combustion chamber 2 via peripheral communication holes 26 at several locations along the periphery of the partition 8. The communication holes 26 are provided outwardly as inclined in the same direction as the current of air within the combustion chamber 2 (FIG. 3). A cylindrical member 27 formed integrally with the partition 7 and adapted to define the aforementioned axial communication hole 25 slightly protrudes into the primary combustion chamber 1 and serves to prevent unburnt fuel particles of heavy weight from entering the secondary combustion chamber 2. The peripheral communication holes 26 are inclined in the direction of the swirl generated within the secondary combustion chamber 2 (FIG. 3). The secondary combustion chamber 2 and the tertiary combustion chamber 3 are respectively provided with secondary and tertiary air feed pipes 28, 29 which open tangentially into the combustion chambers similarly to the primary air feed pipe 12 of the primary combustion chamber 1. The two feed pipes 28, 29 are connected to the blower 14 respectively via switch valves 30, 31.

A tubular dust collector 32 is provided through the axial part of the partition 9 which constitutes the terminal wall behind the tertiary combustion chamber 3. A combusted gas delivery pipe 33 is supported in position by a refractory member 34 so as to pass through the tubular dust collector 32. The inner terminal of this delivery pipe protrudes into the tertiary combustion chamber 3. The inner terminal of the delivery pipe 33 is extended into the tertiary combustion chamber 3 lest it should come into contact with the inner wall of the tubular dust collector 32 and the inner wall of the tertiary combustion chamber 3. The outer terminal of the delivery pipe is joined to a boiler or some other heat-exchanger (not shown).

Figure 4:
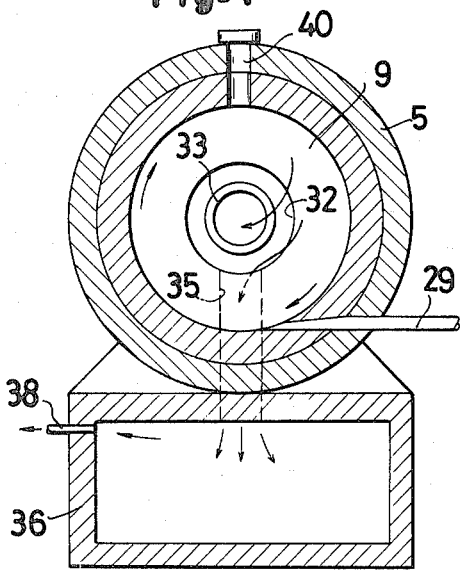
FIG. 4 is a sectioned view taken along the line IV—IV in FIG. 1.

The aforementioned tubular dust collector 32 communicates with a dust collector 36 via a vertical passage 35 disposed in the radial direction. The upper portion of the dust collector 36 can be provided with a tertiary combusted gas pipe 37 as indicated by a chain line in FIG. 1. The other end of this combusted gas pipe 37 is disposed within the combusted gas delivery pipe 33 so as to open in the direction of the down-stream side of the gas flow. Thus, the pipe 37 serves to forward the hot air in the dust collector 36 into the delivery pipe 33. Optionally, the dust collector 36 may be provided with an air vent 38 (FIG. 4). The primary combustion chamber 1 and the tertiary combustion chamber 3 are provided respectively with inspection windows 39, 40 which permit inspection of the condition of combustion inside.

In the combustion apparatus of the construction described above, when the drive unit 22 for the fuel storage hopper 20 and the blower 14 are simultaneously started, the screw 23 supplies the granular fuel in the hopper 20 into the fuel feed pipe 13, wherein the granular fuel is carried on the current of air and discharged inside the primary combustion chamber 14. Inside the primary combustion chamber 1, since the primary air from the blower 14 is being supplied through the primary air feed pipe 12, the granular fuel tending to fall donwardly inside the chamber by its own weight is aerially agitated and fluidized in a swirled state. Thus, combustion can be started on the granular fuel in the swirled state by opening the switch valve 19 and, at the same time, igniting the gas from the cylinder 15 by means of the ignition plug 17 and leading the flame into the primary combustion chamber 1. Since the primary combustion chamber 1 and the secondary combustion chamber 2 communicate with each other solely via the axial communication hole 25, the unburnt fuel particles of heavy weight are caused to remain in the peripheral portion of the combustion chamber and continue to burn there by virtue of the centrifugal force of the swirl. The gas entraining light ashes resulting from the combustion is allowed to pass through the axial communication hole 25 and reach the interior of the secondary combustion chamber 2.

The secondary combustion chamber and the third combustion chamber 3 communicate with each other through the peripheral communication holes 26 instead of through an axial hole. Because of this arrangement, the gas which has entered the secondary combustion chamber 2 is not allowed to blow directly into the tertiary combustion chamber 3 but is fed with the secondary air brought in a swirled state through the secondary air feed pipe 28. Thus, the gas is again agitated into a strong swirl within the chamber 2 and then led through the peripheral communication holes 26 into the tertiary combustion chamber 3.

In the tertiary combustion chamber 3, the gas introduced in a swirled state mixes itself with the swirled current of air brought in through the tertiary air feed pipe 29 and continues its combustion. After this, the combusted gas of an elevated temperature is drawn out of the combusted gas delivery pipe 33.

As described above, the combustion apparatus of the present invention enables the combustion of the fuel to continue in the swirled current through the primary combustion chamber 1 and the secondary and tertiary combustion chambers 2, 3 successively, so that the fuel can be maintained in an agitated, fluidized state for a long time. It is known that combustion of fuel held in such a fluidized state curbs the generation of $NO_x$ and $SO_x$ and, therefore, contributes to the prevention of air pollution. Moreover, this combustion apparatus has the advantage that it can use low-quality coals, for example, coals with high-sulfur content.

Because the ashes of combustion in the combusted gas are carried by the gas in the swirled state, they are readily collected in the outer region of the tertiary combustion chamber 3 separated from the central region owing to the centrifugal force exerted on the swirled current of the gas. The ashes thus collected are forwarded from the annular dust collector 32 through the vertical passage 35 into the dust collector 36.

It is known that when the temperature within a combustion chamber rises above about 800° C., the solid fuel in the presence of very small amounts of water and oxygen (combustion air) undergoes a reaction indicated by the following formulas to produce water gas and facilitate the combustion of granular coal (C).

$$H_2O+C \rightarrow CO+H_2$$

$$CO+H_2+O_2 \rightarrow CO_2+H_2O$$

In the combustion system of this invention, therefore, water feed pipes 44, 45, and 46 which communicate with a tank 47 via valves 41, 42, and 43 are connected respectively to the primary, secondary, and tertiary air feed pipes 12, 28, and 29 as illustrated in FIG. 5, so that very small amounts of water required for the reaction productive of the water gas will be supplied to the corresponding combustion chambers.

By serially adding to the primary combustion chamber a plurality of subsequent combustion chambers as described above, the present invention can provide a large combustion apparatus capable of generating a large amount of heat.

Figure 7:
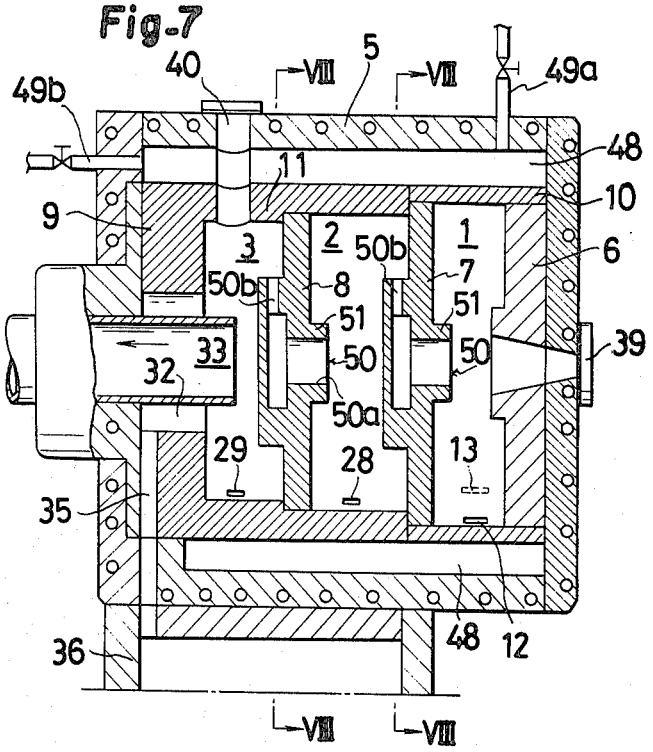
FIG. 7 is a longitudinal cross section of the essential part of the second embodiment of the combustion apparatus according to this invention.
Figure 8:
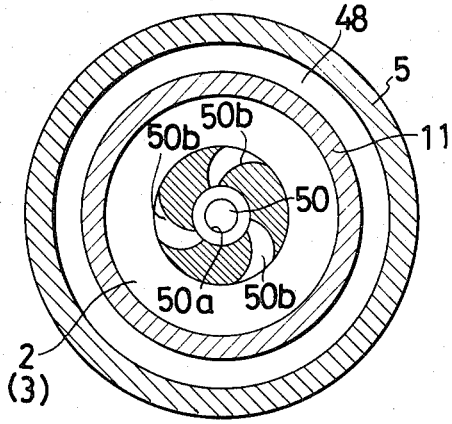
FIG. 8 is a sectioned view taken along the line VIII—VIII in FIG. 7.

The second embodiment of the combustion system of the present invention illustrated in FIGS. 7–8 represents an improvement attained by the incorporation of means for effectively imparting a gyration to the gas flowing through the communication holes 25, 26 provided in the partitions 7, 8 intervening between the combustion chambers. The embodiment will be described with reference to the drawings. Similarly to the combustion apparatus of the first embodiment, the combustion apparatus of the present embodiment is chiefly composed of the primary combustion chamber 1, the secondary combustion chamber 2, and the tertiary combustion chamber 3. These combustion chambers are horizontal cylinders with their respective axes running horizontally. Between the inner wall surface and the outer wall surfaces respectively of the insulating structure 5 and the tubular members 10, 11 which jointly form the outer shell of the aforementioned combustion chambers, there is interposed an empty space for forming a water jacket 48. This water jacket is provided with a feed water inlet **49*a* and a water outlet 49*b*. The partitions 7, 8 intervening between the primary and secondary combustion chambers 1, 2 and between the secondary and tertiary combustion chambers 2, 3 are perforated with holes serving as communication paths 50 for permitting communication between the combustion chambers. Each of the communication paths 50 is composed of an axial communication hole 50*a* for admitting the combustion gas from the combustion chamber on the upstream side and a peripheral communication holes 50*b* for releasing the admitted gas toward the outer region of the combustion chamber on the downstream side. The peripheral communication holes 50*b* are designed to lie substantially in the tangential direction of the combustion chamber as illustrated in FIG. 8. The tubular member 51 perforated with the axial communication hole 50*a*** slightly protrudes into the combustion chamber on the upstream side so as to prevent the unburnt fuel particles of heavy weight from flowing into the combustion chamber on the downstream side.

In the combustion apparatus constructed as described above, the combustion of the granular fuel is started by feeding the granular fuel to the primary combustion chamber, aerially agitating and fluidizing the fuel in a swirled state, and igniting the fuel kept in that state similarly to the combustion apparatus of the first embodiment.

The communication path 50 formed in the partition 7 intervening between the primary combustion chamber 1 and the second combustion chamber 2 is designed so that the entrance side of the axial communication hole **50*a* protrudes into the primary combustion chamber 1 side. During the combustion of the fuel, therefore, the unburnt fuel particles of heavy weight are retained in the outer region of the chamber interior by virtue of the centrifugal force of the swirl and allowed to continue combustion there. The gas containing light ashes resulting from the primary combustion is allowed to enter the axial communication hole 50*a***.

Because of the shape of the communication path 50, the gas which has entered the axial communication hole **50*a* is advanced via the peripheral communication holes 50*b* and discharged into the secondary combustion chamber 2. In this case, since the peripheral communication holes 50*b* are disposed substantially in the tangential direction of the secondary combustion chamber 2, the gas is again made to flow in a swirled state and continue combustion within the combustion chamber 2. The secondary air supplied through the secondary air feed pipe 28** is effective in intensifying this swirled flow of the gas and aiding in the continuation of the combustion.

The gas which has undergone further combustion within the secondary combustion chamber as described above is passed through the communication path 50 in the partition 8 and led into the tertiary combustion chamber 3. Since the design of the communication path 50 in the partition 8 is substantially the same as that of the communication path 50 in the partition 7, the gas which is introduced into the tertiary combustion chamber 3 is made to flow in a swirled state in much the same way as in the secondary combustion chamber 2. The swirled current of air brought in through the tertiary air feed pipe 29 intensifies the swirled flow of the gas and aids in the continuation of the combustion. Finally, the combusted gas of an elevated temperature is drawn out through the combustion gas delivery pipe 33.

Because the gas is kept in the swirled state, the ashes of combustion entrained by the gas tend to be collected in the outer region away from the central region within the tertiary combustion chamber 3. The ashes thus collected are forwarded from the annular dust collector 32 to the interior of the dust collector 36 via the vertical path 35 disposed in the radial direction.

In the combustion apparatus of the present embodiment, since the combustion effected continuously through the primary combustion chamber and the secondary and tertiary combustion chambers occurs in a strong swirl, the agitated and fluidized state of the fuel can be maintained for a long time.

FIGS. 9–13 illustrate the third embodiment of the combustion apparatus according to the present invention. The secondary combustion chamber 2 which adjoins the primary combustion chamber 1 is designed to provide as efficient combustion of the granular fuel as the primary combustion chamber 1. The primary combustion chamber 1, the secondary combustion chamber 2, and the tertiary combustion chamber 3 having a dust collector connected thereto on the rearward side are horizontal cylinders having their axes horizontal. Further in the present embodiment, the refractory member 5 constituting the combustion chambers has embedded therein a circulation pipe 52 for circulating cooling water or cooling air.

Figure 11:
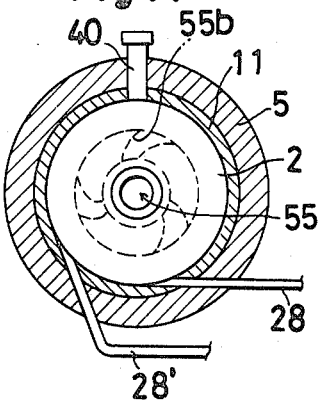
FIG. 11 is a sectioned view taken along the line XI—XI in FIG. 9.

The partition 7 intervening between the combustion chambers 1, 2 has an axial communication hole 53 formed at the center thereof. The peripheral wall of the axial communication hole 53 slightly protrudes in the axial direction from both sides of the partition 7. Further, the partition 7 is perforated with a plurality of communication holes 54 each inclined in the direction of the swirled flow of the fuel within the combustion chamber 1. On the other hand, the communication path 55 formed in the partition 8 intervening between the secondary and tertiary combustion chambers 2, 3 has the same structure as that of the second embodiment. Specifically, it comprises an axial communication hole 55*a* for admitting the combustion gas from the secondary combustion chamber 2 and peripheral communication holes 55*b* for releasing the introduced gas in a swirled state toward the peripheral region of the tertiary combustion chamber 3. These peripheral communication holes 55*b* are desired to be disposed each in a tangential direction relative to the tertiary combustion chamber 3 as illustrated in FIG. 11. The tubular member in which the axial communication hole 55*a* is formed protrudes into the secondary combustion chamber 2 so as to prevent those unburnt fuel particles of heavy weight from entering the combustion chamber on the downstream side.

Into the combustion chamber 1, a fuel feed pipe 13 disposed tangentially to the combustion chamber opens at a lower point of the chamber. At the circumferentially front and rear sides of the combustion chamber 1 relative to this fuel feed pipe 13, a primary air feed pipe 12 and an ignition flame guide pipe 17′ disposed tangentially in the same direction open into the combustion chamber 1. The primary air feed pipe 13 and the ignition flame guide pipe 17′, similarly to those in the first embodiment illustrated in FIG. 5, are made to communicate with a blower. To the ignition flame guide pipe 17′ is connected a gas cylinder via an ejector and a switch valve. The ignition gas which has been mixed with air by the ejector is ignited by an ignition plug. The ignited flame thus produced is guided by the pipe 17′ into the combustion chamber 1.

The fuel feed pipe 13 extending from the combustion chamber 1 terminates into the aforementioned blower. The fuel feed pipe 13 interconnecting the blower and the combustion chamber is joined by a fuel mixing pipe inside a fuel storage hopper. The granular fuel in the hopper, therefore, is forwarded through this fuel feed pipe to the combustion chamber.

Figure 12:
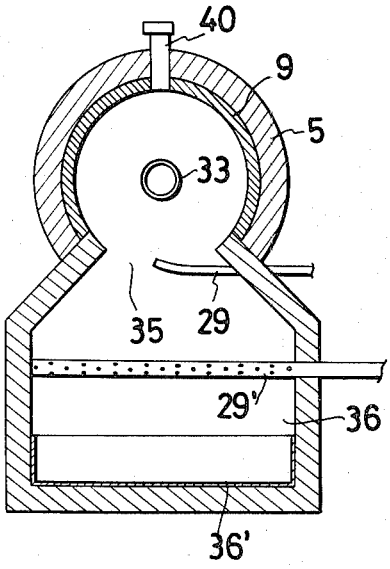
FIG. 12 is a sectioned view taken along the line XII—XII in FIG. 9.
Figure 10:
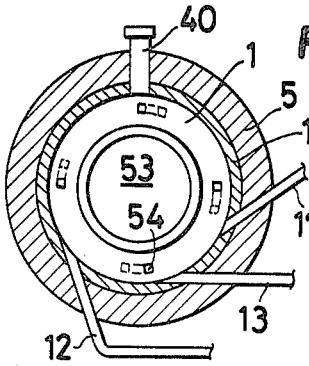
FIG. 10 is a sectioned view taken along the line X—X in FIG. 9.
Figure 13:
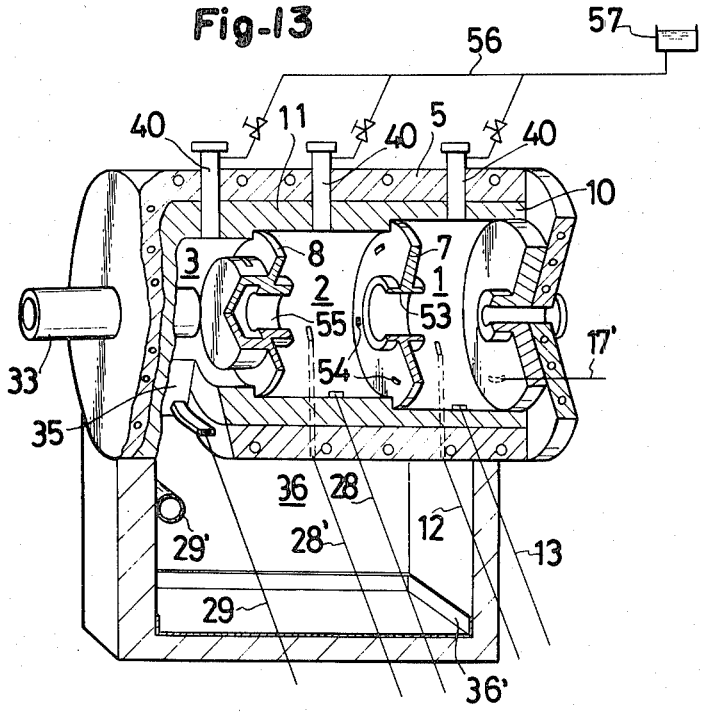
FIG. 13 is a partially sectioned perspective view of the combustion apparatus of FIG. 9.

Into the secondary combustion chamber 2, two secondary air feed pipes 28, 28′ disposed tangentially relative to the combustion chamber 2 open as illustrated in FIGS. 11, 13. And into the tertiary combustion chamber 3, a tertiary air feed pipe 29 opens in a tangential direction as illustrated in FIGS. 12, 13. All these air feed pipes are connected to the blower via their respective switch valves.

The dust collector 36 provided underneath the combustion chamber 3 communicates with the combustion chamber 3 via a vertical path 35. In the present embodiment, the vertical path 35 diverges both in the longitudinal and lateral directions from the combustion chamber 3 side to the dust collector 36 side so as to provide an ample area of communication between the combustion chamber 3 and the dust collector 36. The dust collector 36 is provided in the lower portion thereof with a freely extractable tray 36′. Into the upper portion of the dust collector 36 is inserted an air feed pipe 29′ for final combustion of the fuel within the dust collector 36.

The combusted gas delivery pipe 33 is inserted from outside into the interior of the aforementioned combustion chamber 3. The inner end of the delivery pipe 33 is opposed to the combustion chamber 3 so that it will not border on any of the inner wall surfaces. The outer end of the delivery pipe 33 is connected to a boiler or heat exchanger, for example. The combustion chambers 1, 2, and 3 are provided each with an inspection window 40 adapted to permit inspection of the condition of combustion within the combustion chambers.

In the combustion apparatus constructed as described above, the granular fuel is supplied through the fuel feed pipe 12 into the combustion chamber 1 as carried on the current of air produced by the blower. Since the primary air from the blower is separately supplied through the primary air feed pipe 12 into the combustion chamber 1, the granular fuel which tends to fall downwardly inside the combustion chamber by its own weight is aerially agitated and fluidized amply in a swirled state. Particularly since the primary air feed pipe opens into the combustion chamber on the downstream side relative to the fuel feed pipe 13, the primary air lowers the static pressure at the discharge point of the granular fuel, causes the granular fuel to be efficiently drawn in, provides thorough aerial agitation and fluidization of the granular fuel, and consequently enjoys the advantage of preventing the fuel from being deposited on the inner wall of the combustion chamber 1. When the flame is introduced through the ignition flame guide pipe 17′ into the combustion chamber 1 while the granular fuel is held in the thoroughly agitated and fluidized state, therefore, the combustion of the fuel in the spirally fluidized state will start.

The gas consequently generated in a swirled state within the combustion chamber 1 enters the combustion chamber 2 through the axial communication hole 53 and the plurality of peripheral communication holes 54 pierced through the partition 7 and continues combustion in the swirled state therein. The secondary air supplied through the two secondary air feed pipes 28, 28′ in the tangential direction into the combustion chamber 2 functions effectively in intensifying the swirled flow of the gas and aiding in continuation of the combustion.

The gas in the swirled state finally finds its way into the combustion chamber 3 through the communication path 55 formed in the partition 8. Since, on the combustion chamber 3 side, the peripheral communication holes 55*b* of the communication path 55 are disposed in the tangential directions relative to the peripheral wall of the combustion chamber 3, the gas entering the combustion chamber 3 combined with the current of air being introduced through the tertiary air feed pipe 29 is allowed to continue its combustion in the swirled state.

Further since the communication path 55 constitutes the axial communication hole 55*a* on the secondary combustion chamber 2 side and this communication hole is in the shape of a protruding tube, the unburnt fuel particles of heavy weight which are kept in the outer region of the interior of the combustion chamber by the centrifugal force of the swirled current of the combustion gas are effectively prevented from entering the aforementioned combustion chamber 3. The protruding tubular wall provided for the axial communication hole 53 through the partition 7 fulfills the same function. The gas of an elevated temperature is drawn out of the combustion apparatus through the combusted gas delivery pipe 33. Since the combustion effected in the present combustion apparatus proceeds in the strongly swirled current of fuel and air, the agitated and fluidized state of the fuel can be maintained long and the combustion itself can be carried out efficiently.

The ashes of combustion are led through the vertical path 35, dropped into the dust collector 36 possessing an amply large space compared with the combustion chamber 4, and finally collected in the tray 36'. Within this dust collector 36, the unburnt portion of the fuel is subjected to final combustion with fresh air supplied through the feed pipe 29'. The gas from this combustion rises and flows back into the combustion chamber 3.

For supply of very small amounts of water to the combustion chambers for aiding in the reaction productive of the water gas, the air feed pipes communicating with the respective combustion chambers may be utilized as in the combustion system of the first embodiment. Optionally, water feed pipes 56 issuing from a water tank 57 may be connected to the inspection windows 40 as illustrated in FIG. 13, so that suitable amounts of water will be delivered downwardly through the water feed pipes into the combustion chambers to accelerate the reaction for the formation of the water gas.

The embodiments described above represent cases involving three serially connected combustion chambers. The number of these combustion chambers used in the apparatus may be decreased to two or increased to four or more as occasion demands.

Figure 14:
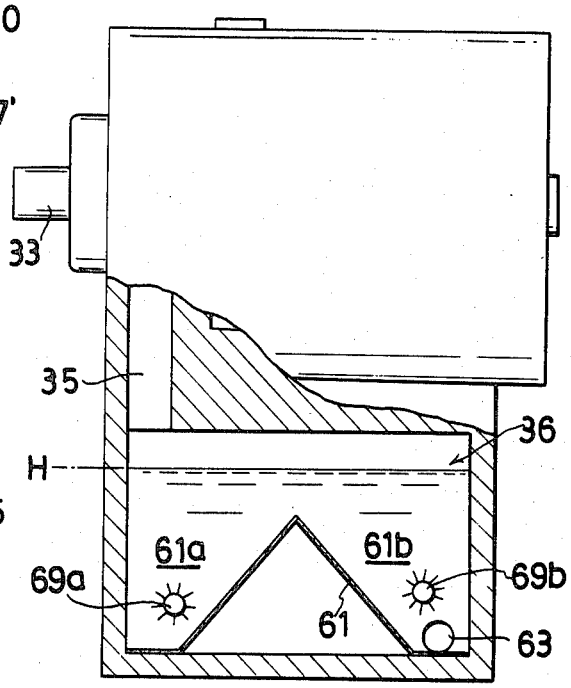
FIG. 14 is a sectioned view illustrating the condition in which a device for the removal of combustion ashes is disposed in the dust collector of the combustion apparatus of the present invention.
Figure 15:
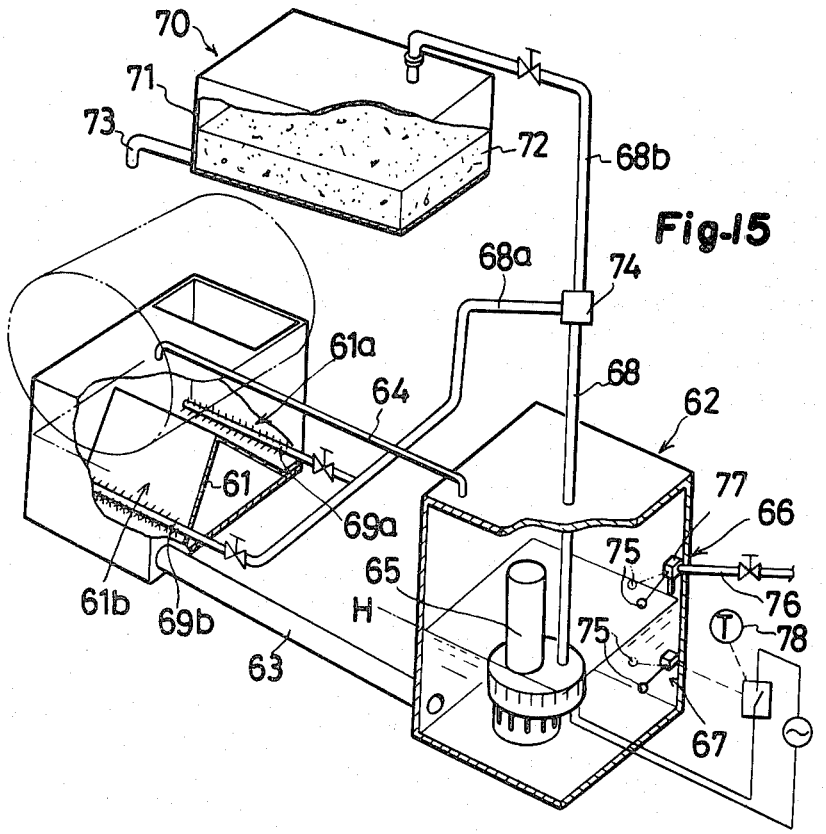
FIG. 15 is a partially sectioned piping system diagram illustrating the condition in which the device for the removal of combustion ashes is incorporated in the combustion apparatus of the present invention.
Figure 9:
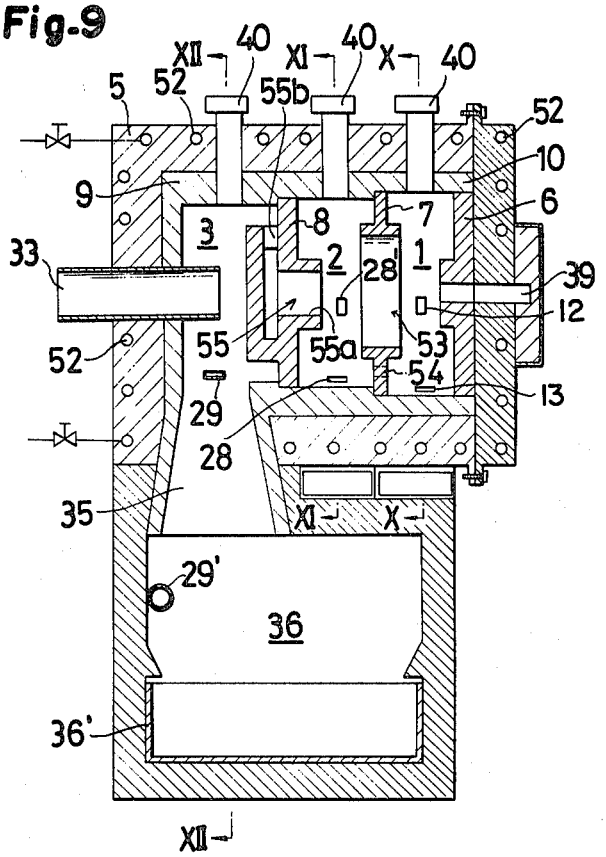
FIG. 9 is a longitudinal cross section illustrating the third embodiment of the combustion apparatus according to the present invention.

The combustion apparatuses described above are such that the ashes of combustion can be removed therefrom without interrupting the combustion so far as the apparatuses are small. When the combustion apparatuses are medium to large, however, the gases produced therein are under the conditions of high temperature and high pressure. An attempt to remove the ashes of combustion under such harsh conditions may result in the escape of pressure or heat and, worse still, in personal injury. Thus, safe removal of the ashes cannot be obtained until the operation of the combustion apparatus is stopped. This means that the combustion apparatus of the present invention built on a commercial scale cannot be operated continuously for a long time and that practical utility of the combustion apparatus is seriously restricted. This invention solves this problem by providing an ash removal device for the dust collector 36 which communicates with the combustion chamber 3. The ash removal device will be described specifically below with reference to FIGS. 14, 15. The dust collector 36 is provided with a partition board 61 of a triangular cross section so as to have the lower part thereof divided into two sections 61*a*, 61*b*. The section 61*a* is located below the combustion chamber 3. The two sections 61*a*, 61*b* are liquid-tightly separated from each other.

Moreover, this dust collector 36 is provided on the outside thereof with a closed tank 62. The bottom of this closed tank 62 communicates with the bottom of the section 61*b* through a communication path 63. Further, the upper part of the dust collector 36 communicates with the upper part of the closed tank 62 through a pressure equalizing pipe 64. Normally the two enclosures are kept under an equal pressure at all times.

Within the closed tank 62, there are disposed an underwater (sand) pump 65, a fixed level water feeder 66, and a liquid level detector 67. On departing from the closed tank 62, the discharge pipe 68 of the underwater pump 65 is divided into two branch pipes 68*a*, 68*b*. The branch pipe 68*a* is connected to agitation pipes 69*a*, 69*b* within the sections 61*a*, 61*b* and the other branch pipe 68*b* is connected to a sedimentation bag 70. The agitation pipes 69*a*, 69*b* are each provided with a multiplicity of water spurting nozzles on the peripheries thereof. When the water issuing from the underwater pump 65 is spurted out through these agitation pipes, the ashes settled within the sections 61*a*, 61*b* are thoroughly agitated by the spurted water. As a solid-liquid separator, the sedimentation bag 70 has a filter material 72 in a tank 71. The dust-containing water discharged from the discharge pipe 68 is poured onto the filter material 72. The water cleaned with the filter material 72 is released through a discharge pipe 73.

The water discharged from the underwater pump 65 is selectively supplied to the branch pipe 68*a* or the branch pipe 68*b*. For the selective supply of this discharged water, a flow path switch means 74 is provided where the branch pipes 68*a*, 68*b* are separated. The flow path switch means 74 comprises a known switch valve which causes the discharged water to flow to the branch pipe 68*a* side for a fixed time after the start of the underwater pump 65 and after elapse of this fixed time, causes the discharged water to flow to the branch pipe 68*b* side.

The aforementioned fixed level feeder 66 is adapted to open or close a switch valve 77 of the water feed pipe 76 by means of a float 75 which rises or falls with the liquid level. It serves to control the maximum water level to which the water supplied by the water feed pipe 76 is allowed to enter the closed tank 62 and the dust collector 36. This maximum water level H is higher than the upper edge of the partition board 61 disposed within the dust collector 36. With the aid of the float 75, the aforementioned liquid level detector 67 senses the time at which, because of the operation of the underwater pump 65, the water level within the closed tank 62 falls below the fixed mark. On detection of this fall of the water level, the detector 67 issues a signal for the underwater pump 65 to stop its operation. Of course, the signal for stopping or starting the operation of the underwater pump 65 may be issued at the discretion of the operator. For the purpose of automatic operation, it is desirable to use a timer 78 adapted to start the operation periodically.

In the ash removal device constructed as described above, the ashes produced by the combustion of the granular solid fuel fall into the water kept to a fixed level within the dust collector 36. As the combustion of the solid fuel continues, the ashes which at first dissolve in the water eventually begins to pile up so much as to rise above the water level within the dust collector 36. When the accumulation of ashes reaches this level, the timer 78 sets the underwater pump 65 operating. Consequently, the water discharged from this pump is delivered through the discharge pipe 68, the flow path switch means 74, and the branch pipe 68*a*, to the agitation pipes 69*a*, 69*b* and spurted through the injection nozzles into the sections 61*a*, 61*b*, with the result that the water and the ashes within the sections 61*a*, 61*b* are agitated and mixed. Since the water level is higher than the upper edge of the partition board 61 intervening between the sections 61*a*, 61*b*, the agitation and mixing occurs in the two sections at the same time. Particularly, water containing ashes moves from the section 61*a* to the section 61*b*, because the former section is located directly below the combustion chamber 4 and, therefore, contains more ashes.

Then, the flow path switch means 74 begins to forward the discharged water from the underwater pump 65 to flow to the branch pipe 68*b* side and the water containing ashes begins to fall onto the filter material 72 of the sedimentation bag 70. Consequently, the water level within the closed tank 62 and the dust collector which communicates with the closed tank through the communication path 63 continues to fall until the liquid level detector 67 stops the operation of the underwater pump 65. In this manner, the ashes of combustion are removed in conjunction with water. Concurrently, the water level in the section 61*b* which receives falling ashes continues to fall in concert with the water level within the tank 62. Since the section 61*a* is liquid-tightly separated from the section 61*b* by the partition board 61, the water level within this section 61*a* does not fall below the upper edge of the partition board 61. Consequently, the ashes of combustion incessantly falling from the combustion chamber even during the operation of the underwater pump 65 can be safely collected in the water held within the section 61*a*. By the time the operation of the underwater pump 65 is stopped, the float 75 has already opened the switch valve 77 and the water feed pipe 76 has started supplying water into the closed tank 62. Shortly, the supplied water raises the water level within the closed tank 62 and the dust collector to the original mark H. At fixed intervals, therefore, the procedure described above is repeated to effect the removal of the ashes of combustion without interrupting the combustion.

The dusty water supplied onto the filter material 72 of the sedimentation bag 70 is freed from ashes by the filter material 72 and discharged through the discharge pipe 73. The ashes retained on the filter material 72 are suitably removed afterward. Optionally, the water from the water feed pipe 76 may be supplied to the closed tank 62 while the discharged water from the underwater pump 65 is allowed to flow to the branch pipe 68*b* side.

In the embodiment described above, the dust collector 36 is divided into two sections and one of the two sections thus divided is adapted to be filled with water at all times. Thus, this embodiment enjoys the advantage that the ashes of combustion are safely collected in the water even when they are being removed elsewhere. The automatic removal of the ashes of combustion may be obtained without having to divide the dust collector into two sections as described above. Optionally, the start or stop of the operation of the underwater pump may be manually effected. Further, as the solid-liquid separation means, some suitable device other than the sedimentation bag may be adopted.

In summary, the combustion apparatus of the present invention causes the granular fuel to be burnt as aerially agitated and fluidized in a swirled state through a plurality of horizontal cylindrical combustion chambers serially joined and made to communicate with each other, then guides the swirled flow of the gas into the combusted gas delivery chamber, and finally extracts the combusted gas from the swirled flow. Thus, it permits the granular fuel to be retained continuously in an agitated and fluidized state for a long time and enables the fuel itself to be burnt efficiently. Since the combustion apparatus enables the so-called fluidized-bed combustion to be safely carried out for a long time, it ensures efficient combustion of the solid fuel and consequent generation of high thermal power. Further, since the ashes of combustion are collected in the dust collector disposed immediately below the combusted gas delivery chamber, they can be disposed of very easily. The cylindrical combustion chambers and the combusted gas delivery chamber are of a horizontal type and the combusted gas delivery pipe opposed to the delivery chamber is also of a horizontal type. Thus, they can be used in their unmodified form in the existing oil-burning boilers and driers.

Examples of the granular fuels which can be used in this invention include powdered coal and other crushed solid fuels, and C heavy oil and other similar heavy oils blended with powdered coal, quick lime, dolomite, and other powdery substances. When the granular fuel happens to contain quick lime or dolomite, for example, such additive substance serves to desulfurize the gas within the combustion chambers and obviates the necessity for providing an expensive desulfurizing device. When a solid fuel such as powdered coal is used in the blended fuel, even waste oil or oil of inferior quality can be burnt completely.

The incorporation of the combustion ash removal device in the dust collector permits the combustion apparatus to be continuously operated for a long time and enhances the practical utility of the combustion apparatus.

What is claimed is:

1. A combustion apparatus for a granular solid fuel, which comprises in combination:

a horizontal cylindrical combustion enclosure, at least one circular partition for dividing the interior of said combustion enclosure into a plurality of cylindrical combustion chambers, said partition being provided with communication holes for the combustion gas, a fuel feed pipe opening into the first of said plurality of combustion chambers, air feed pipes opening one each into said plurality of combustion chambers, a combusted gas delivery pipe having one end thereof communicating with the last of said plurality of combustion chambers, and a dust collector disposed directly below said combustion chambers and made to communicate with the last of said plurality of combustion chambers and receive ashes of combustion falling from the combustion chambers, said dust collector being provided with ash removal means comprising a closed tank adapted to communicate with the dust collector through a communication path disposed in the bottom portion of said dust collector and a pressure equalizing pipe disposed in the upper portion of said dust collector, water feed means for feeding water to the closed tank and to the dust collector via the communication path until the water level rises to a prescribed mark, an underwater pump disposed within said closed tank, solid-liquid separation means adapted to communicate with the discharge pipe of said underwater pump, agitation pipes laid within said dust collector, a switch valve for switching the connection of the discharge pipe of said underwater pump between said solid-liquid separation means and said agitation pipe, and a partition board of a triangular cross section for dividing said dust collector into two sections at a position lower than the water level to which the water is supplied to the dust collector, said two sections being provided with agitation pipes and one of the two sections being provided with a communication path leading to the closed tank.

2. A combustion apparatus for a granular solid fuel, which comprises in combination:

a horizontal cylindrical combustion enclosure, at least one circular partition for dividing the interior of said combustion enclosure into a plurality of cylindrical combustion chambers, said partition being provided with communication holes for the combustion gas, a fuel feed pipe opening into the first of said plurality of combustion chambers, air feed pipes opening one each into said plurality of combustion chambers, a combusted gas delivery pipe having one end thereof communicating with the last of said plurality of combustion chambers, and a dust collector disposed directly below said combustion chambers and made to communicate with the last of said plurality of combustion chambers and receive ashes of combustion falling from the combustion chambers, said dust collector being provided with ash removal means comprising a closed tank adapted to communicate with the dust collector through a communication path disposed in the bottom portion of said dust collector and a pressure equalizing pipe disposed in the upper portion of said dust collector, water feed means for feeding water to the closed tank and to the dust collector via the communication path until the water level rises to a prescribed mark, an underwater pump disposed within said closed tank and adapted to be started by a timer and stopped by a liquid level detector adapted to sense the fall of the liquid level in the closed tank below a prescribed mark, solid-liquid separation means adapted to communicate with the discharge pipe of said underwater pump, agitation pipes laid within said dust collector, and a switch valve for switching the connection of the discharge pipe of said underwater pump between said solid-liquid separation means and said agitation pipe.

* * * * *